United States Patent [19]

O'Connor et al.

[11] 3,947,941

[45] Apr. 6, 1976

[54] METHOD OF MAKING A HEAT EXCHANGER

[75] Inventors: Joseph M. O'Connor, Chicago; Stephen F. Pasternak, Park Ridge, both of Ill.

[73] Assignee: Peerless of America, Incorporated, Chicago, Ill.

[22] Filed: Jan. 14, 1975

[21] Appl. No.: 541,060

[52] U.S. Cl. ..... 29/157.3 B; 165/181

[51] Int. Cl.[2].. B21D 53/02; B23P 15/26; F28F 1/26

[58] Field of Search. 29/157.3 A, 157.3 B, 157.3 V, 29/DIG. 33, 202 D; 113/118 R, 118 A, 118 B; 72/333, 253, 379; 165/181

[56] References Cited

UNITED STATES PATENTS

| | | | |
|---|---|---|---|
| 2,553,142 | 5/1951 | McCreary | 113/118 A |
| 3,247,583 | 4/1966 | Hansson et al. | 29/157.3 V |
| 3,269,459 | 8/1966 | Popovitch | 165/17 UX |
| 3,781,959 | 1/1974 | O'Connor | 29/157.3 B |

*Primary Examiner*—Charles J. Myhre
*Assistant Examiner*—Theophil W. Streule, Jr.
*Attorney, Agent, or Firm*—Johnson, Dienner, Emrich & Wagner

[57] ABSTRACT

A heat exchanger embodying an elongated tubular member with integral elongated fins extending transversely thereacross and projecting outwardly therefrom, the fins having integral openings extending therethrough.

6 Claims, 6 Drawing Figures

METHOD OF MAKING A HEAT EXCHANGER

BACKGROUND OF THE INVENTION

This invention relates to heat exchangers and, more particularly, to heat exchangers of the finned type.

It is a primary object of the present invention to afford a novel heat exchanger and a novel method of making the same.

Another object is to afford a novel finned heat exchanger wherein the fins are formed by cutting or gouging the same from wall portions of the heat exchanger.

Another object of the present invention is to enable a novel heat exchanger to be afforded in a novel and expeditious manner, wherein secondary heat transfer surfaces may be formed by cutting or gouging them out of tubular stock, to afford fins having internal openings extending therethrough.

An object ancillary to the foregoing is to enable such heat exchangers to be afforded in a novel and expeditious manner with elongated openings through the fins thereof.

Heat exchangers embodying fins formed from the outer surface material of tubular members have been heretofore known in the art, being disclosed, for example, in Richard W. Kritzer U.S. Pat. No. 3,202,212 and Joseph M. O'Connor U.S. Pat. No. 3,692,105, wherein, in the aforementioned Kritzer patent, the fins are in the form of spines formed from outwardly projecting ribs on the tubular member; and, in the aforementioned O'Connor patent, the fins are formed by cutting or gouging them from such outwardly projecting ribs and the portion of the tubular member directly underlying the ribs, to thereby afford fins having elongated base portions projecting outwardly from the side wall of the tubular member, with spaced spines projecting outwardly from the outer longitudinal edges of the base portions.

Also, heat exchangers embodying perforated fins formed from the outer surface material of tubular members have been heretofore known in the art, being disclosed, for example, in the Stephen F. Pasternak application for U.S. Pat., Ser. No. 438,750, filed Feb. 1, 1974 now U.S. Pat. No. 3,886,639 granted June 3, 1975. In the aforementioned application, the fins are formed by cutting or gouging them from outer surface portions of a tubular member, which portions have openings extending therethrough longitudinally of the tubular member.

Heat exchangers of the type disclosed in the aforementioned Kritzer and O'Connor patents and in the aforementioned Pasternak application have proven to be very effective. However, it is an object of the present invention to afford improvements over heat exchangers of the type disclosed in the aforementioned patents and application.

Another object of the present invention is to afford a novel heat exchanger of the finned type, wherein the fins are constructed in a novel and expeditious manner.

One of the disadvantages heretofore encountered, from time to time, in finned heat exchangers of the type wherein the fins are cut or gouged from outer surface material of a tubular member has been that, when the tubular members have been driven through cutting or gouging machines by drive members which frictionally engaged the surfaces from which the fins are formed, the frictionally engaged surfaces were marked by the drive member, with the result that the surfaces of the finished fins bore such marks and were roughened thereby. Such roughened surfaces have been known to cause an increased pressure drop and a reduced air flow, as compared to smoothsurfaced fins, when air is passed between such fins transversely to the length of the tubular member. It is another important object of the present invention to enable such an increase in pressure drop to be prevented.

Another object of the present invention is to enable such roughened surfaces to be eliminated in a novel and expeditious manner.

A further object is to enable a tubular member to be driven in a novel, positive-drive manner through a machine in which the fins are cut or gouged from the outer surface material of the tubular member.

Also, the formation of longitudinally extending openings in tubular members, such as the openings through which cuts or gouges are made in following the method disclosed in the aforementioned Pasternak application, Ser. No. 438,750, now U.S. Pat. No. 3,886,639 granted June 3, 1975 causes certain difficulties or problems. For example, when the holes are formed in an extruding operation, the provision of the necessary pins in the extrusion dies causes problems, which, of course, are not insurmountable, but are substantial. It is another important object of the present invention to overcome such problems.

An object ancillary to the foregoing is to overcome such problems while yet affording a tubular member having openings in the outer surface material, and through which openings cuts may be made, when cutting or gouging the surface material, to thereby afford fins having perforations therethrough.

Another object of the present invention is to afford a novel tubular member having openings through which cuts may be made in the aforementioned manner, and wherein the openings are constituted and arranged in a novel and expeditious manner in the outer surface material of the tubular member.

Yet another object is to enable such openings to be formed in the outer surface material of a tubular member in a novel and expeditious manner.

A further object of the present invention is to enable longitudinal movement of a tubular member and the formation of openings in the outer surface material thereof to be simultaneously effected in a novel and expeditious manner.

Another object of the present invention is to afford a novel method of manufacturing an elongated tubular member having openings in the outer surface material thereof, wherein the tubular member is longitudinally moved simultaneously with the formation of the aforementioned openings.

An object ancillary to the foregoing is to enable the movement of the tubular member and the formation of the openings in the outer surface thereof to be accomplished in a novel and expeditious manner.

A further object of the present invention is to afford a novel heat exchanger which is practical and efficient in operation, and which may be readily and economically produced commercially.

Other and further objects of the present invention will be apparent from the following description and claims and are illustrated in the accompanying drawings which, by way of illustration, show preferred embodiments of the present invention and the principles thereof and what we now consider to be the best mode in which we have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENTS SHOWN HEREIN

A heat exchanger element or heat transfer element 1, embodying the principles of the present invention, is shown in FIGS. 1–4 of the drawings as one end portion of an elongated tubular member 2, to illustrate the presently preferred embodiment of the present invention, and to illustrate the presently preferred method of making heat exchangers in accordance with the principles of the present invention.

As will be discussed in greater detail hereinafter, in the preferred practice of the present invention, the heat exchanger element 1 is preferably formed from a suitable length of tubular stock, such as the tubular member 2, working from one end portion A of the tubular member 2, FIG. 4, toward the other end B thereof, and severing the heat exchanger 1 from the remainder B–C of the tubular member 2 upon completion of the forming of the desired length of heat exchanger, such as, for example, the length A–C.

Figure 1:
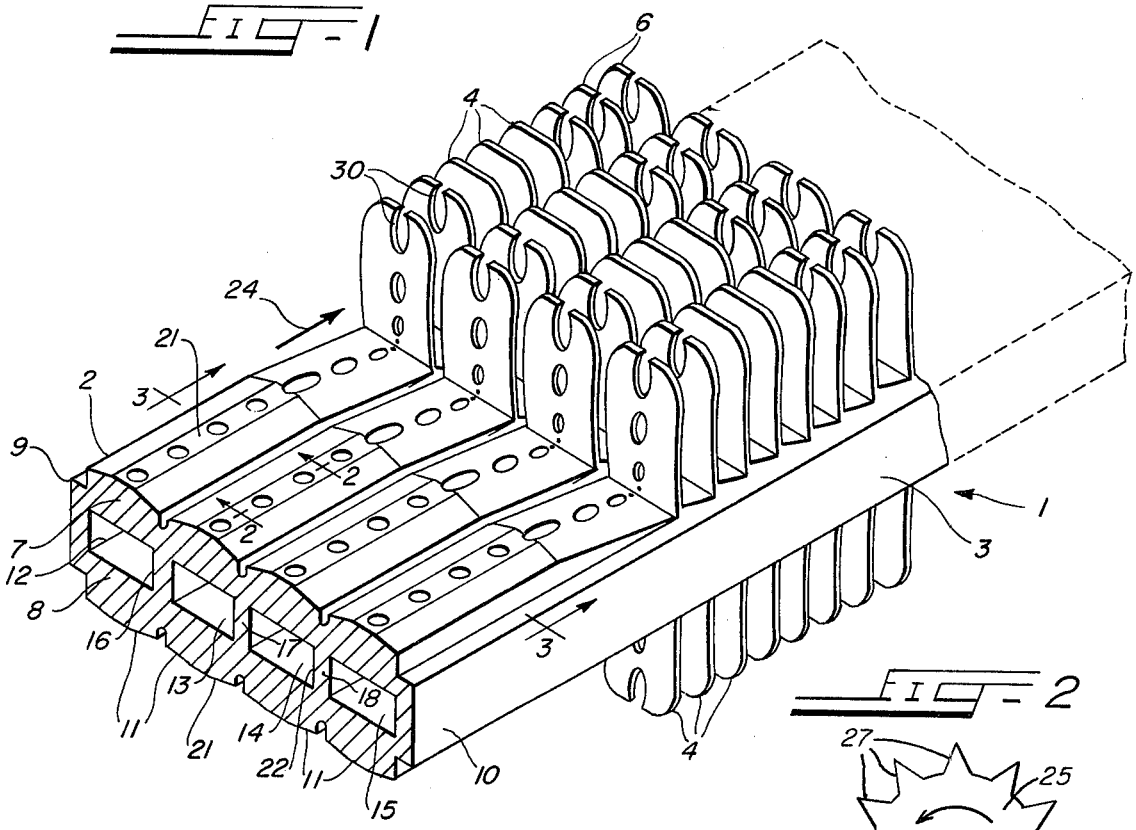
FIG. 1 is a perspective view of a length of a heat exchanger element embodying the principles of the present invention.
Figure 3:
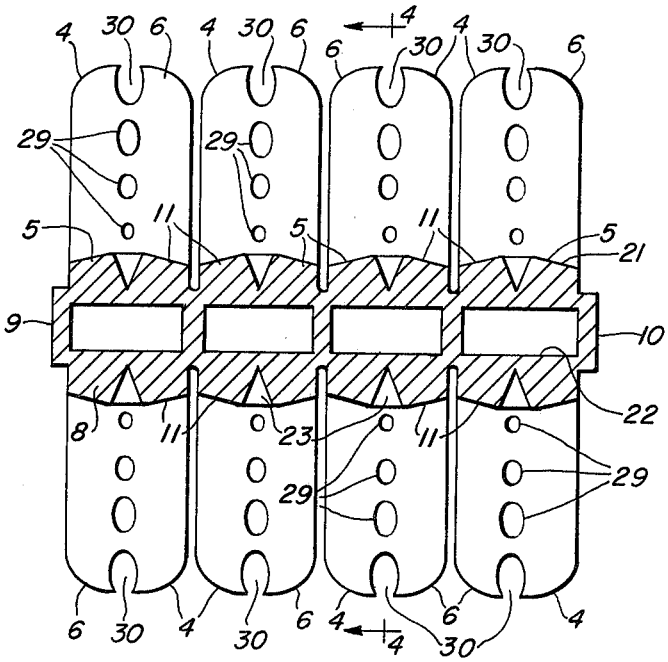
FIG. 3 is a transverse sectional view taken substantially along the line 3—3 in FIG. 1.
Figure 4:
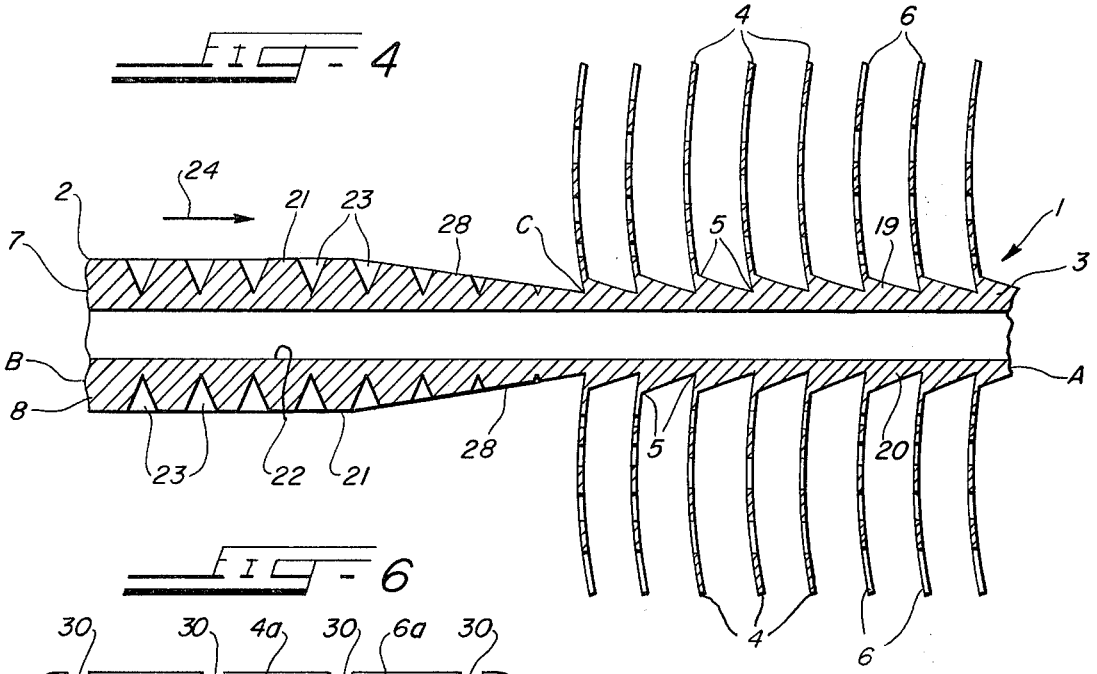
FIG. 4 is a fragmentary, longitudinal sectional view taken substantially along the line 4—4 in FIG. 3.

The heat exchanger element 1 embodies, in general, an elongated, tubular body portion 3 having elongated fins 4 projecting outwardly therefrom, each of the fins 4 embodying an elongated base 5 and an elongated outer edge 6, FIGS. 1, 3 and 4.

The tubular member 2 shown in the drawings is substantially rectangular in transverse cross-section, embodying a top wall 7 and a bottom wall 8 disposed in substantially parallel relation to each other, and two oppositely disposed side walls 9 and 10 extending between respective side edges of the walls 7 and 8 in substantially perpendicular relation thereto. Preferably, the walls 7 and 8 have a plurality of parallel, longitudinally extending, outwardly projecting ribs 11 projecting outwardly therefrom, for a purpose which will be discussed in greater detail hereinafter. The side walls 9 and 10 may be of any suitable shape, but we prefer that the outer faces thereof be convex-outwardly in shape, as shown in FIGS. 1 and 3.

A plurality of openings 12, 13, 14 and 15, separated from each other by partition walls or panels 16, 17 and 18, respectively, extend longitudinally through the tubular member 2. As will be appreciated by those skilled in the art, the tubular member 2 is shown in FIGS. 1–4 as having a plurality of openings 12–15 extending therethrough merely by way of illustration and not by way of limitation, and tubular members having a single opening extending longitudinally therethrough may be afforded, without departing from the purview of the present invention.

Figure 2:
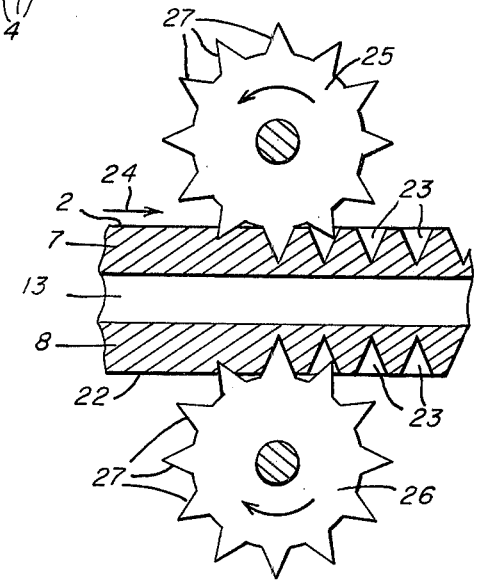
FIG. 2 is a fragmentary, longitudinal sectional view taken through a tubular member prior to the formation of fins thereon, looking in the direction of the arrows 2—2 in FIG. 1, and showing, somewhat diagramatically, drive mechanism not shown in FIG. 1.

In the heat exchanger 1 shown in the drawings, the fins 4 project outwardly from the outer faces of two walls 19 and 20, FIG. 2, corresponding to, and, in fact, formed form walls 7 and 8 of the tubular member 2, as will be discussed in greater detail presently. The fins 4 extend longitudinally across the respective walls 19 and 20, transversely to, and, preferably, in substantially perpendicular relation to the length of the tubular body portion 3, and each of the fins 4 embodies one of the aforementioned elongated bases 5 which is integral with the respective wall 19 or 20 to which it is attached. Each of the fins 4 projects outwardly from the respective wall 19 or 20, and, preferably, is disposed in substantially perpendicular relation thereto. The outer edges 6 of each of the fins 4, which are disposed on respective sides of tubular body portion 3, preferably are disposed in uniplanar relation to each other. Each of the walls 7 and 8 of the tubular member 2 embodies an outer face 21 and an inner face 22, FIGS. 1, 3 and 4.

The tubular member 2 from which the heat exchanger 1 is made, may be made of any suitable material, such as, for example, aluminum. The tubular member 2 may be made in any suitable manner, such as, for example, by extruding the same, and prior to the formation of the fins 4 thereon, a plurality of openings or depressions 23 are formed in the outer faces 21 and 22 of the ribs 11 on the walls 7 and 8, respectively, for a purpose which will be discussed in greater detail presently.

Preferably, in the practice of the present invention, the tubular member 2, after it has been suitably formed, is fed longitudinally through a suitable cutting machine, and, while it is so moving therethrough, the fins 4 are cut or gouged from the walls 7 and 8 in a manner which will be discussed in greater detail presently. The movement of the tubular member 2 through the aforementioned machine is in the direction of the arrows 24, FIGS. 1, 2 and 4, and preferably is effected by suitable feed rollers or feed wheels 25 and 26, FIG. 2, in the machine, which are engaged with the outer faces of the ribs 11 on the walls 7 and 8, respectively, of the tubular member 2. Each of the feed rollers has a plurality of projections or teeth 27 on the outer periphery thereof, which are effective, during engagement with and the feeding of the tubular member 2 thereby, to cut or form the openings 23 in the outer faces of the ribs 11. Preferably, the spacing of the rollers 25 and 26 is such that only the projections 27 thereon engage the walls 7 and 8 of the tubular member 2, during the feeding of the latter, so as to eliminate the possibility of marking the outer faces 21 of the tubular member 2 between the openings 23 by reason of engagement of the rollers 25 and 26 therewith.

As will be appreciated from the foregoing by those skilled in the art, the engagement of the projections 27 on the feed rollers 25 and 26 with the tubular member 2 not only is effective to form the openings 23 therein, but by reason of the engagement of the projections 27 in the openings 23 during rotation of the feed rollers 25 and 26, a positive drive for the tubular member 2 is afforded. The projections 27 are so spaced circumstantially around the feed rollers 25 and 26 that at least one of the projections 27 on each of the feed rollers 25 and 26 is engaged with the tubular member 2 at all times. The projections 27 may have any suitable shape, but are shown herein as being substantially cone-shaped so that they are effective to form substantially cone-shaped openings 23, FIGS. 2 and 4.

In the preferred practice of the present invention, as illustrated in the drawings, the openings 23 are formed in each of the ribs 11 in a single line extending longitudinally thereof, with adjacent openings in adjacent ones of the ribs being disposed in alignment with each other transversely to the length of the tubular member 2, FIG. 1. As will be appreciated by those skilled in the art, this pattern of the openings may be varied without departing from the purview of the broader aspects of the present invention.

In making the heat exchanger 1, as the tubular member 2 is fed longitudinally and after openings 23 have been formed therein, the fins 4 may be successively formed on each of the side walls 7 and 8 from a portion of the tubular member 2 in which the openings 23 have been formed. The fins 4 may thus be formed from the one end portion A toward the other end B thereof, FIG. 2, and each of the fins 4 may be cut or gouged from the wall 7 or 8 by means of a suitable cutting tool, not shown, which first cuts along lengthwise of the respective face 21 to the right as viewed in FIG. 4, to form the surface 28 which extends transversely across a plurality of openings 23 spaced from each other longitudinally of each of the ribs 11, and terminates at its inner end at the bottom of the ribs 11 in a horizontal plane disposed between the inner ends of the openings 23 and the adjacent inner face 22 of the respective wall 7 or 8. Each of the fins 4 which has been cut or gouged from the body portion 2, may then be bent outwardly preferably to a position wherein it is disposed substantially perpendicular to the plane of the wall 7 or 8 on which it is formed.

The formation of the fins 4, by the passage of a cutting tool transversely across some of the openings 23, causes a plurality of elongated openings or passageways 29 to be formed in each of the finished fins 4, FIGS. 1 and 3, at the location where the cutting tool cuts across the openings 23. Thus, adjacent fins 4, formed from adjacent ribs 11, are disposed in uniplanar relation to each other, with each fin 4 having a plurality of openings 29 extending therethrough.

It has been found that when fins are formed in the manner hereinbefore described with respect to the fins 4, the compression of the fin material during the cutting operation causes the height of the finished fins to be substantially less than the length of cut, commonly being in the nature of one-half of the length of cut, so that, for example, to afford fins 4 with a height of one-half inch, the length of cut along the surface 28 would be substantially one inch. The fins 4 may be of any suitable thickness, and the thickness of fins of the type of the fins 4 may commonly be in the range of two-thousandths of an inch to one-eighth of an inch when the fins 4 are formed in the above described manner. The openings 29 are formed in the finished fins at progressively lower portions of the openings 23 through which the cutting tool passes. As a result, the openings 29 in each of the fins 4 are progressively smaller from the top to the bottom of the fin, FIG. 3, the tool cutting through progressively narrower portions of adjacent ones of the holes 23. Because the cuts are made at an acute angle to the longitudinal axis of the tubular member 2, so that the cutting tool passes through the openings 23 at an acute angle to the longitudinal axes of the latter, the openings 29 are elongated vertically in the finished fins 4.

After thus forming the fins 4 along the desired length of the tubular member 2, such as the length A–C, the tubular mameber 2 may be severed transversely to its length at any points between points A and C to thereby afford a finished heat exchanger element having fins 4 extending substantially the full length thereof. As will be appreciated by those skilled in the art, if desired, the formation of the fins 4 may be commenced inwardly of the end portion A of the tubular member 2, and the tubular member 2 may be severed outwardly to the left, as viewed in FIG. 4, of the last formed fin 4 to thereby afford end portions which project outwardly from the outermost fins 4, and thus afford connecting members at each end of the finished heat exchanger. In such last mentioned construction, not shown, the wall portions 7 and 8 of the tubular member 2 disposed outwardly of the aforementioned outermost fins 4, preferably are reduced in thickness to that of the wall portions 19 and 20 by suitable means, such as, for example, grinding, to thereby afford a smooth-walled end portion for the completed heat exchanger, with the thickness of the top and bottom walls of the end portions being the same as that of the walls 19 and 20 of the heat exchanger.

It is to be observed that when cuts are commenced at the outer surface 21 on either of the side walls 7 or 8 at one of the openings 23, indentations or notches 30 are formed in the leading edges 6 of the fins 4, but when such cuts are initiated between openings 23, the outer edges 6 are continuous and do not embody such notches. As a result, when the spacing of the cuts is such that a plurality of successive cuts are initiated at one of the openings 23 and, thereafter, a plurality of cuts are initiated between openings 23, groups of fins 4 having notches 30 in the outer edge portion 6 and groups of fins 4 not having such notches in the outer edge portion 6 are alternately disposed longitudinally of the heat exchanger 1.

It will be seen that in practicing the above described novel method of forming a heat exchanger, a postiive drive is afforded for moving a tubular member through the machine in which fins are cut or gouged from the side walls of the tubular member. Also, it will be seen that practicing this method enables openings to be formed in the side walls of a tubular member in a novel and expeditious manner, which, when they are thereafter cut, afford fins having openings therethrough.

In addition, it will be seen that in practicing the aforementioned novel method, the positive drive for the tubular member and the formation of the openings in the side walls of the tubular member may be accomplished by the same operating members, which, in the preferred practice of the present invention, are drive rollers or wheels, such as the rollers 25 and 26.

Figure 6:
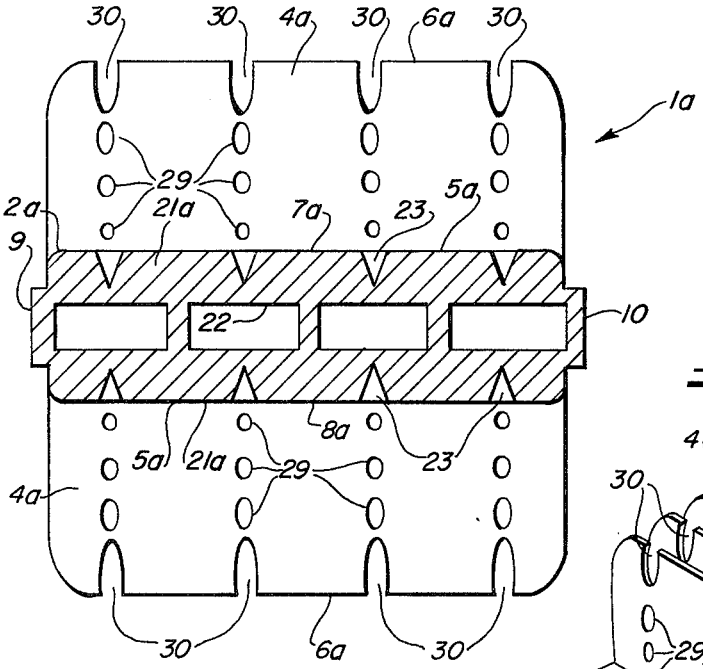
FIG. 6 is a transverse sectional view taken substantially along the line 6—6 in FIG. 5.

In FIGS. 6 and 7 of the drawings, a heat exchanger 1*a* is shown to illustrate a modified form of the present invention, parts which are the same as parts in the heat exchanger 1 shown in FIGS. 1–4 being indicated by the same reference numerals, and parts which are similar to parts of the heat exchanger 1 being indicated by the same reference numerals, with the suffix *a* added thereto.

Figure 5:
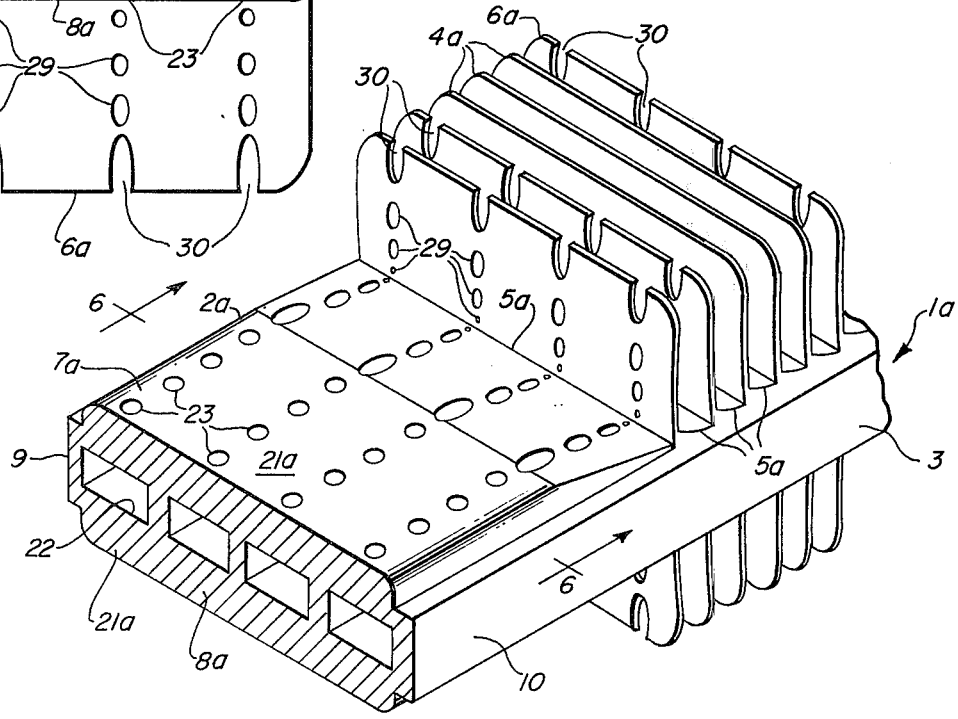
FIG. 5 is a perspective view, similar to FIG. 1, but showing a modified form of the present invention.

In the heat exchanger 1a, the tubular member 2a is formed without any ribs on the walls 7a and 8a, the outer surfaces 21a being uniplanar in construction, FIG. 5. As a result, when the fins 4a are formed in the same manner and with the same length of cut as heretofore discussed with respect to the formation of the fins 4, elongated rectangular fins 4a are formed, with the length thereof extending transversely across the entire width of the body portion 3. Preferably, the walls 7a and 8a are of such thickness, and the depth of cut therein, in the formation of the fins 4a, is such that the base portions 5a of the fins 4a are disposed the same distances from the lower ends of the openings 23 and the inner surfaces 22 of the tubular member 2a as in the form of the invention shown in FIGS. 1–4.

As in the heat exchanger 1, the fins 4a have openings 29 extending therethrough, which are disposed in inwardly spaced relation to the outer edges 6a and the base edges 5a thereof, and embody alternate groups of fins 4a which have and have not the notches 30 in the outer edges 6a thereof.

From the foregoing it will be seen that the present invention affords a novel heat exchanger of the finned type.

Also, it will be seen that the present invention affords a novel method of forming a finned heat exchanger, having openings extending through the fins.

Also, it will be seen that the present invention affords a novel heat exchanger which is practical and efficient in operation and which may be readily and economically produced commercially.

Thus, while we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. The method of making a heat transfer element, comprising a. forming an elongated tubular member having a wall portion having
1. an inner face,
2. an outer face, and
3. a plurality of openings
a. in said outer face,
b. extending into said tubular member and terminating at their inner ends in outwardly spaced relation to said inner face,
c. spaced from each other transversely to the length of said tubular member, and
d. spaced from each other longitudinally of said tubular member, b. successively from one end portion of said tubular member toward the other end portion thereof,
1. making cuts into said tubular member, at an acute angle to the length of said tubular member, from said outer face to a depth wherein the cuts extend across certain of said openings and terminate at their inner ends in outwardly spaced relation to said inner face to thereby afford
a. elongated fins
1′. extending across said tubular member in a direction transverse to the length thereof,
2′. having elongated base portions directly attached to the underlying portion of said tubular member, 3′. having elongated outer edge portions extending transversely to the length of said tubular member, and
4′. having openings extending therethrough in spaced relation to said base portions and said outer edge portions, and
2. turning said fins outwardly into outwardly projecting relation to said tubular member.

2. The method defined in claim 1, and in which a. adjacent ones of said cuts are spaced from each other longitudinally of said tubular member less than the width of said openings longitudinally of said tubular member and less than the spacing of adjacent ones of said openings longitudinally of said tubular member to thereby cause
1. openings to be formed in said outer edge portions of certain of said fins, and
2. said outer edge portions of other of said fins to be formed without openings therein.

3. The method defined in claim 1, and which includes a. moving said tubular member longitudinally by drive means engaged in said first mentioned openings during said making of cuts into said tubular member.

4. The method defined in claim 1, and which includes a. moving said tubular member longitudinally and simultaneously forming said first mentioned openings by engaging drive means having projections thereon with said outer face.

5. The method of making a heat transfer element, comprising a. forming an elongated tubular member having a wall portion having
1. an inner face, and
2. an outer face, b. moving said tubular member longitudinally and simultaneously forming a plurality of spaced openings in said outer face by rotating a drive member, which is round in transverse crosssection and has projections in such position that at least one of said projections is engaged with said outer face at all times for movement in the direction of said longitudinal movement of said tubular member, c. successively from one end portion of said tubular member toward the other end portion thereof
1. in the direction of said movement of said longitudinal member and during said moving of said tubular member, making a plurality of elongated cuts, which extend transversely to the length of said tubular member and are spaced from each other longitudinally of the tubular member, at such an acute angle to the length of said tubular member and to such a depth from said outer face that said cuts extend transversely across a plurality of said openings, which are spaced from each other longitudinally of said tubular member, and that said cuts terminate at their inner ends in outwardly spaced relation to said inner face to thereby afford a plurality of fins
a. extending transversely across said tubular member,
b. each having an elongated base portion directly attached to an underlying portion of said base member,
c. each having an elongated outer edge portion extending transversely across said tubular member, and d. each having a plurality of openings extending therethrough between said base portion and said outer edge portion, and 2. turning said fins outwardly in said direction of said movement of said longitudinal member into outwardly projecting relation to said tubular member.

6. The method of making a heat transfer element defined in claim 5, and which includes a. so spacing said cuts longitudinally of said tubular member that 1. certain of said cuts are initiated at certain of said first mentioned openings, and 2. other of said cuts are initiated between adjacent ones of said first mentioned openings, to thereby form fins having notched and un-notched outer edge portions, respectively.

* * * * *

UNITED STATES PATENT OFFICE

CERTIFICATE OF CORRECTION

Patent No. 3,947,941 Dated April 6, 1976

Inventor(s) Joseph M. O'Connor & Stephan F. Pasternak

It is certified that error appears in the above-identified patent and that said Letters Patent are hereby corrected as shown below:

Column 1, line 44-45 change "3,886,639 granted June 3, 1975" to --3,901,312 granted August 26, 1975--;

Column 2, line 20-21 change "3,886,639 granted June 3, 1976 to--3,901,312 granted August 26, 1975--.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*